US006794804B2

(12) United States Patent
Kanao et al.

(10) Patent No.: US 6,794,804 B2
(45) Date of Patent: Sep. 21, 2004

(54) PRODUCTION METHOD OF SPARK PLUG DESIGNED TO PROVIDE HIGH TEMPERATURE OXIDATION RESISTANCE AND WELD STRENGTH AND SPARK PLUG PRODUCED THEREBY

(75) Inventors: Keiji Kanao, Kariya (JP); Tsunenobu Hori, Kariya (JP)

(73) Assignee: Denso Corporation, Kariya (JP)

( * ) Notice: Subject to any disclaimer, the term of this patent is extended or adjusted under 35 U.S.C. 154(b) by 124 days.

(21) Appl. No.: 10/225,459

(22) Filed: Aug. 22, 2002

(65) Prior Publication Data

US 2003/0062815 A1 Apr. 3, 2003

(30) Foreign Application Priority Data

Aug. 22, 2001 (JP) ..... 2001-251896
Jul. 4, 2002 (JP) ..... 2002-196148

(51) Int. Cl.[7] ..... H01T 1/24; H01T 21/02
(52) U.S. Cl. ..... 313/141; 445/7
(58) Field of Search ..... 445/7; 313/141

(56) References Cited

U.S. PATENT DOCUMENTS 5,472,663 A 12/1995 Kitamura et al.
6,080,029 A * 6/2000 Johnson et al. ..... 445/7
6,460,506 B1 * 10/2002 Nevinger ..... 123/260
6,603,244 B2 * 8/2003 Sugiyama et al. ..... 313/118

FOREIGN PATENT DOCUMENTS

| | | |
|---|---|---|
| GB | 432484 | 7/1935 |
| GB | 549631 | 11/1942 |
| JP | 54-142148 | 11/1979 |
| JP | 61-273268 | 12/1986 |
| JP | 1-180787 | 7/1989 |
| JP | 3206119 | 7/2001 |

* cited by examiner

*Primary Examiner*—Kenneth J. Ramsey
(74) *Attorney, Agent, or Firm*—Nixon & Vanderhye P.C.

(57) ABSTRACT

A spark plug and a production method thereof is provided which is designed to improve the high temperature oxidation resistance of a ground electrode without sacrificing the mechanical strength of a weld of the ground electrode with a metal shell. The ground electrode is made of a Ni-based alloy containing 10% or more by weight of Cr and 1.5% or more by weight of Al and joined to the metal shell by resistance welding in a substantially oxygen free atmosphere.

9 Claims, 8 Drawing Sheets

| Type | | Component of Ni-based alloy (weight %) | | | | | | ΔG (mm) | |
|---|---|---|---|---|---|---|---|---|---|
| | | Cr | Al | Si | Mn | Fe | Ni + Inevitable Impurity | Electrode Temp. 970°C | Electrode Temp. 1070°C |
| Sample Material | No1 | 2.2 | 5.0 | 0.18 | 0.25 | 8.2 | Bal. | 0.22 | 0.35 |
| | No2 | 8.2 | 0.1 | 0.18 | 0.25 | 8.2 | Bal. | 0.32 | 0.61 |
| | No3 | 8.4 | 2.9 | 0.21 | 0.22 | 8.0 | Bal. | 0.18 | 0.31 |
| | No4 | 10.5 | 0.2 | 0.20 | 0.15 | 7.4 | Bal. | 0.15 | 0.37 |
| | No5 | 10.0 | 1.5 | 0.18 | 0.20 | 7.6 | Bal. | 0.08 | 0.27 |
| | No6 | 15.2 | 0.8 | 0.20 | 0.23 | 7.9 | Bal. | 0.06 | 0.34 |
| | No7 | 16.1 | 1.5 | 0.20 | 0.17 | 7.8 | Bal. | 0.05 | 0.23 |
| | No8 | 15.5 | 5.0 | 0.16 | 0.19 | 7.2 | Bal. | 0.05 | 0.09 |
| | No9 | 20.0 | 1.5 | 0.20 | 0.33 | 7.1 | Bal. | 0.04 | 0.15 |
| | No10 | 20.0 | 5.0 | 0.20 | 0.33 | 7.1 | Bal. | 0.04 | 0.12 |
| Prior Art | | 15.7 | 0.1 | 0.23 | 0.16 | 8.1 | Bal. | 0.28 | 0.52 |

FIG. 2

(L=10mm)

| Electrode Thickness C1 (mm) | Electrode Width C2 (mm) | S/V (S : Surface Area V : Volume) |
|---|---|---|
| 0.6 | 1.4 | 4.77 |
| 0.7 | 1.5 | 4.20 |
| 0.8 | 1.6 | 3.76 |
| 0.8 | 2.0 | 3.51 |
| 1.0 | 2.2 | 2.92 |
| 1.2 | 2.5 | 2.48 |
| 1.4 | 2.6 | 2.21 |
| 1.6 | 2.8 | 1.97 |
| 1.6 | 3.3 | 1.87 |
| 1.7 | 3.5 | 1.76 |
| 1.8 | 3.6 | 1.68 |
| 2.0 | 4.0 | 1.51 |

FIG. 5

PRODUCTION METHOD OF SPARK PLUG DESIGNED TO PROVIDE HIGH TEMPERATURE OXIDATION RESISTANCE AND WELD STRENGTH AND SPARK PLUG PRODUCED THEREBY

BACKGROUND OF THE INVENTION

1. Technical Field of the Invention

The present invention relates generally to a method of producing a spark plug to have an increased high temperature oxidation resistance and a weld strength and a spark plug produced thereby.

2. Background Art

Usually, spark plugs used in environmental conditions where they are subjected to heavy thermal loads have a ground electrode made of a Ni-based alloy such as Inconel (trade mark) exhibiting a higher temperature oxidation resistance in order to minimize the wear of the ground electrode arising from its internal progress of spark-caused oxidation.

Modern engines are progressing in lean burning, so that thermal load conditions in which an electrode of a spark plug is heated up to a higher temperature and cooled rapidly is becoming severe. It is presumed that the temperature of the ground electrode will reach an upper limit of a high temperature oxidation resistance of Inconel 600 in the near future, thereby resulting in a difficulty in controlling the spark-caused wear of the ground electrode, which will lead to a decrease in service life of spark plugs.

In order to increase the high temperature oxidation resistance of the ground electrode, use of material is proposed which forms a firm oxide film easily on the surface of the ground electrode at an initial stage of use of the spark plug to arrest the spread of oxidation into the inside of the ground electrode.

The use of such material is excellent in improving the high temperature oxidation resistance of the ground electrode, but however, results in formation of an oxide film on a joint of the ground electrode with a metal shell during welding in the air, thus resulting in an undesirable decrease in mechanical strength of the joint.

SUMMARY OF THE INVENTION

It is therefore a principal object of the invention to avoid the disadvantages of the prior art.

It is another object of the invention to provide a production method of a spark plug which is designed to improve the high temperature oxidation resistance of a ground electrode without sacrificing the mechanical strength of a weld of the ground electrode with a metal shell and a spark plug produced thereby.

According to one aspect of the invention, there is provided a production method of a spark plug which may be employed in automotive internal combustion engines. The spark plug includes a metal shell, a center electrode retained within the metal shell through electric insulation, and a ground electrode opposed to the center electrode through a spark gap. The method comprises: the steps of: (a) preparing the ground electrode made of a Ni-based alloy containing 10% or more by weight of Cr and 1.5% or more by weight of Al; and (b) joining the ground electrode to the metal shell by resistance welding in a substantially oxygen free atmosphere. The results of research made by the inventors of this application showed that the use of the Ni-based alloy containing 10 Wt % or more of Cr and 1.5 Wt % or more of Al causes oxides of Cr and/or Al to be deposited on the surface of the ground electrode to form a firm oxide film thereon which arrests the spread of oxidization into the inside of the ground electrode, thereby minimizing the spark-caused wear of the ground electrode, that is, improving the high temperature oxidation resistance thereof.

Further, welding the ground electrode made of such a material to the metal shell in the air causes an oxide film to be formed easily on a weld interface, thus resulting in a great decrease in mechanical strength of the weld interface. This is avoided in this invention by welding the ground electrode to the metal shell in the substantially oxygen free atmosphere.

In the preferred mode of the invention, the ground electrode contains 20% or less by weight of Cr and 5% or less by weight of Al. This is because too much Cr and Al will result in an undesirable increase in hardness which causes a difficulty in drawing the material of the ground electrode.

The oxygen free atmosphere is provided by an inert gas such as Ar.

If a ratio of a surface area S of the ground electrode to a volume V of the ground electrode is defined as S/V, a relation of $1.8\ mm^{-1} \leqq S/V \leqq 3.9\ mm^{-1}$ is satisfied.

Usually, thickening the ground electrode causes the load required to bend the ground electrode to define a desired spark gap to be increased, which results in ease of breakage or rupture of the ground electrode at the weld interface. Conversely, thinning the ground electrode results in a drop in high temperature oxidation resistance of the ground electrode. The results of research performed by the inventors of this application showed that a relation of $1.8\ mm^{-1} \leqq S/V$ alleviates the rupture of the ground electrode at the weld interface during adjustment of the spark gap, and a relation of $S/V \leqq 3.9\ mm^{-1}$ ensures a desired high temperature oxidation resistance of the ground electrode.

The resistance welding may be performed while applying a jet of given gas producing the oxygen free atmosphere to portions of the ground electrode and the metal shell to be joined. This allows spark plugs to be produced at low costs.

The flow rate of the jet of the given gas is preferably within a range of 2L to 30L per minute.

The use of such a jet usually causes a weld target to be cooled. Since the ground electrode is typically smaller in volume than the metal shell, the ground electrode is cooled rapidly, thus resulting in a decrease in weldability thereof. The results of research made by the inventors of this application showed that the use of a material containing Al in making the ground electrode results in an increase in resistivity thereof, which serves to increase the quantity of heat produced at the ground electrode, thus canceling an adverse effect of the application of the jet of gas to the ground electrode.

According to the second aspect of the invention, there is provided a spark plug which comprises: (a) a metal shell; (b) a center electrode retained within the metal shell through electric insulation; and (c) a ground electrode joined at an end thereof to the metal shell by resistance welding and opposed at the other end to the center electrode through a spark gap. The ground electrode contains 10% or more by weight of Cr and 1.5% by weight of Al. The number of aluminum oxide particles per 0.1 mm in length of a weld interface between the end of the ground electrode and the metal shell is one or less, thereby ensuring a desired mechanical strength of the weld interface.

The ground electrode may be made of a Ni-based alloy containing 20% or less by weight of Cr and 5% of less by weight of Al.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2 is a table which lists materials of ground electrodes of spark plug samples used in evaluating the high temperature oxidation resistance and weld strength of the ground electrodes;

FIG. 5 is a table which lists dimensions of ground electrodes of spark plug samples used in evaluating bendability and high temperature oxidation resistance of the ground electrodes;

FIG. 8(*b*) is a top view of FIG. 8(*a*);

DESCRIPTION OF THE PREFERRED EMBODIMENTS

Figure 1:
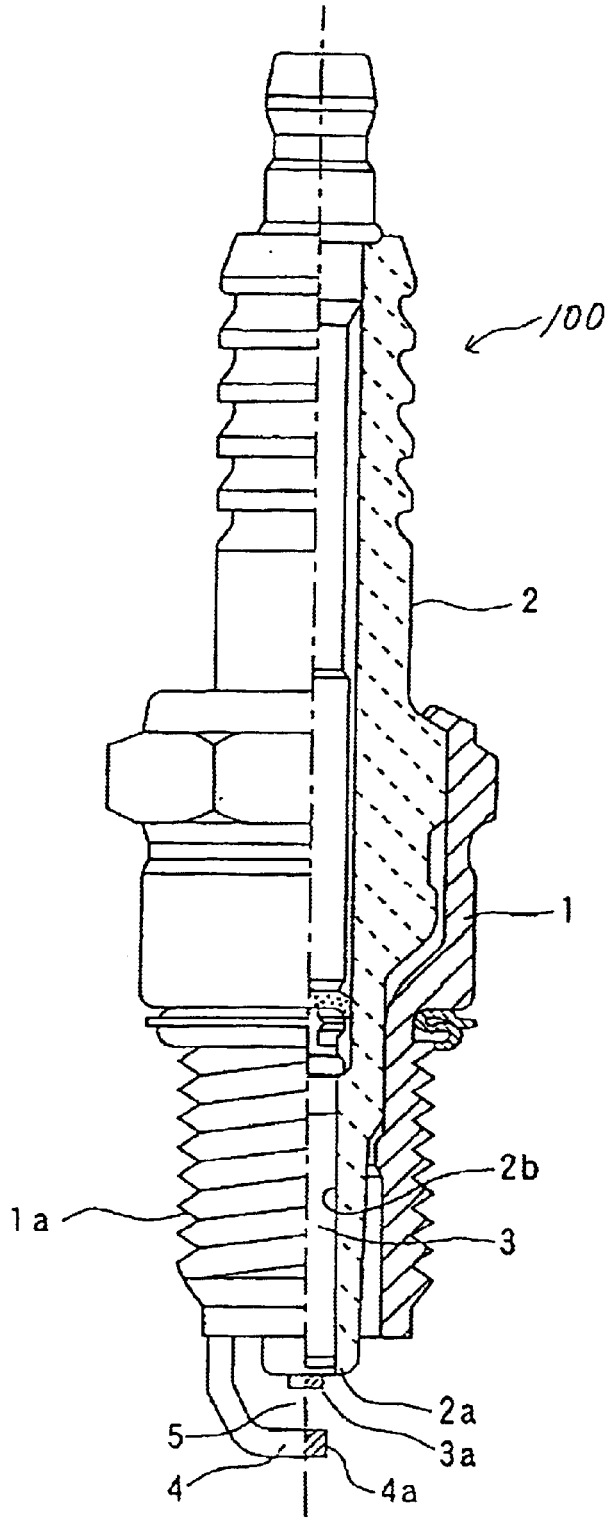
FIG. 1 is a partially sectional view which shows a spark plug with a ground electrode according to the invention.

Referring to the drawings, wherein like reference numbers refer to like parts in several views, particularly to FIG. 1, there is shown a spark plug 100 which may be used in internal combustion engines for automotive vehicles.

The spark plug 100 includes a cylindrical metal shell (housing) 1, a porcelain insulator 2, a center electrode 3, and a ground electrode 4. The metal shell 1 is made of a hollow metallic cylinder and has cut therein a thread 1*a* for mounting the spark plug 100 in a cylinder block of an engine (not shown). The porcelain insulator 2 made of an alumina ceramic ($Al_2O_3$) is retained within the metal shell 1 and has a tip 2*a* exposed outside the metal shell 1.

The center electrode 3 is secured in a central chamber 2*b* of the porcelain insulator 2 and insulated electrically from the metal shell 1. The center electrode 3 has a tip 3*a* projecting from the tip 2*a* of the porcelain insulator 2. The center electrode 3 is formed by a cylindrical member which is made up of a core portion made of a metallic material such as Cu having a higher thermal conductivity and an external portion made of a metallic material such as an Ni-based alloy having higher thermal and corrosion resistances.

The ground electrode 4 is joined at an end thereof directly to an end of the metal shell 1 by resistance welding. The ground electrode 4 is bent to an L-shape to have a tip 4*a* which faces at an inner side surface thereof the tip 3*a* of the center electrode 3 through a spark gap (also called air gap) 5.

We performed high temperature oxidation resistance-evaluating tests on spark plug samples with ground electrodes 4 made of materials No.1 to No.10, as listed in FIG. 2, and a prior art spark plug sample with a ground electrode 4 made of Inconel 600 (trade mark).

The electrode materials No.1 to No.10 are Ni-based alloys containing Cr, Al, Si, Mn, and Fe. We supposed that increases in content of Cr and Al promote formation of an oxide film on the surface of the ground electrodes 4, thereby resulting in improved high temperature oxidation resistances thereof and prepared the electrode materials No.1 to No.10 whose contents of Cr and Al are different from each other to find relations between Cr—Al contents and high temperature oxidation resistances.

Note that too much Cr and Al will result in an undesirable increase in hardness which causes a difficulty in drawing the material of the ground electrode 4, and therefore, Cr and Al contents of each of the electrode materials No.1 to No.10 are 20% or less by weight and 5% or less by weight.

Figure 3:
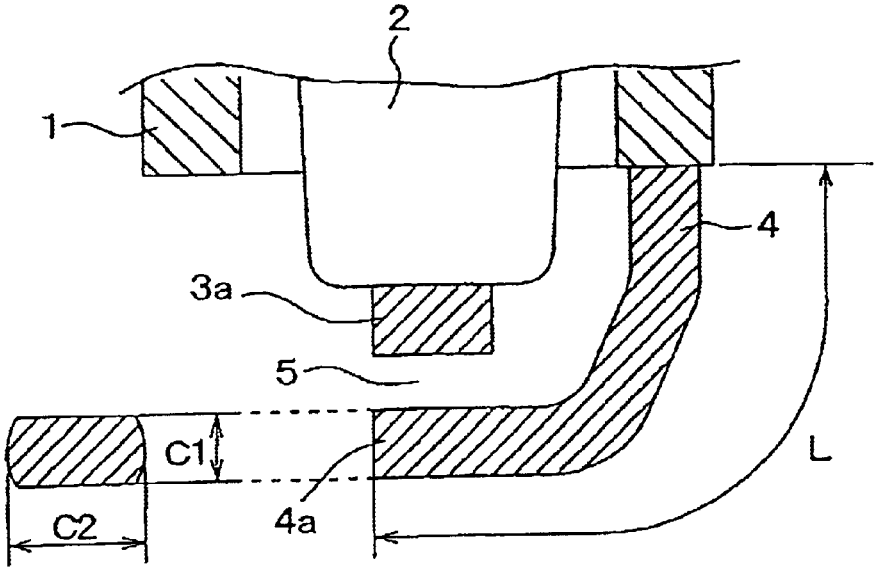
FIG. 3 is a partially enlarged view which shows a spark gap between a ground electrode and a center electrode before a durability test.

The thickness C1, width C2, and length L of the ground electrodes 4, as shown in FIG. 3, are dimensions most commonly used in automotive spark plugs, namely, C1=1.4 mm, C2=2.6 mm, and L=10 mm. A ratio of a surface area S to a volume V of each of the electrodes 4 (i.e., S/V) is 2.21 $mm^{-1}$.

We first performed durability tests on a total of the above described eleventh types of spark plug samples. The tests were accomplished by installing each sample in a 1800 cc engine with a turbocharger and running the engine at speed of 5600 rpm for 120 hours while injecting a mixture whose air-fuel ratio is 12.5 by weight into the engine. During the tests, the temperature of the tip 4*a* of the ground electrode 4 of each sample was 970° C.

Figure 4:
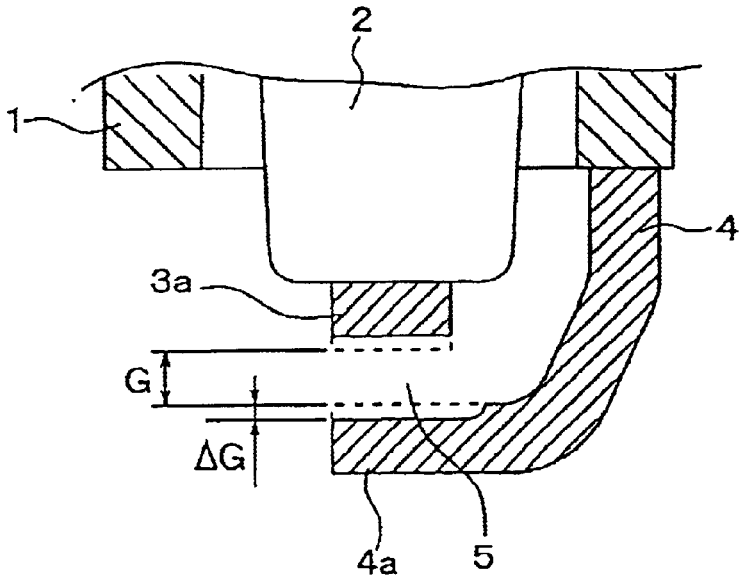
FIG. 4 is a partially enlarged view which shows a spark gap between a ground electrode and a center electrode after a durability test.

After the durability tests, we evaluated the high temperature oxidation resistance of each sample, as shown in FIG. 4, in terms of the amount of wear of the tip 4*a* of the electrode 4 resulting from sparks, that is, an increase ΔG in spark gap 5 on the side of the ground electrode 4. G indicates an initial spark gap before the durability tests.

Results of an analysis of the durability tests made by the inventors of this application showed that when the gap increase ΔG is 0.3 mm or less, it provides a high temperature oxidation resistance meeting requirements in extreme environmental conditions in which spark plugs undergo heavy thermal loads as in lean burn engines. As apparent from the gap increases ΔG, as listed in FIG. 2, by the durability tests where the temperature of the ground electrodes 4 was risen up to 970° C., all the ground electrodes 4 except No. 2 have the high temperature oxidation resistances needed in practical use.

We also performed high-temperature durability tests on spark plug samples in experimental conditions where the temperature of the ground electrode 4 were increased up to 1070° C. since ground electrodes are supposed to be subject to further elevated temperatures in future engines. This elevation in temperature was achieved by advancing ignition timing in each spark plug sample. The spark plug samples used in these tests, like the above tests, were equipped with ground electrodes 4 made of materials No.1 to No.10 and Inconel 600, as listed in FIG. 2. Test conditions were the same as those in the above durability tests except for the advancement of ignition timing.

The graph of FIG. 2 shows that the spark plug samples equipped with the ground electrodes 4 made of the materials Nos. 5 and 7–10 are 0.3 mm or less in the gap increase ΔG and thus excellent in high temperature oxidation resistance.

The sample materials No.7 to No.10 each contain 10 Wt % or more of Cr and 1.5 Wt % or more of Al. It is, thus, found that use of an Ni-based alloy containing 10 Wt % or more of Cr and 1.5 Wt % or more of Al as material of the ground electrode 4 results in improved high temperature oxidation resistance thereof.

We also evaluated the bendability and high temperature oxidation resistance of the ground electrode 4 for different values of S/V, as shown in FIG. 5.

Figure 6:
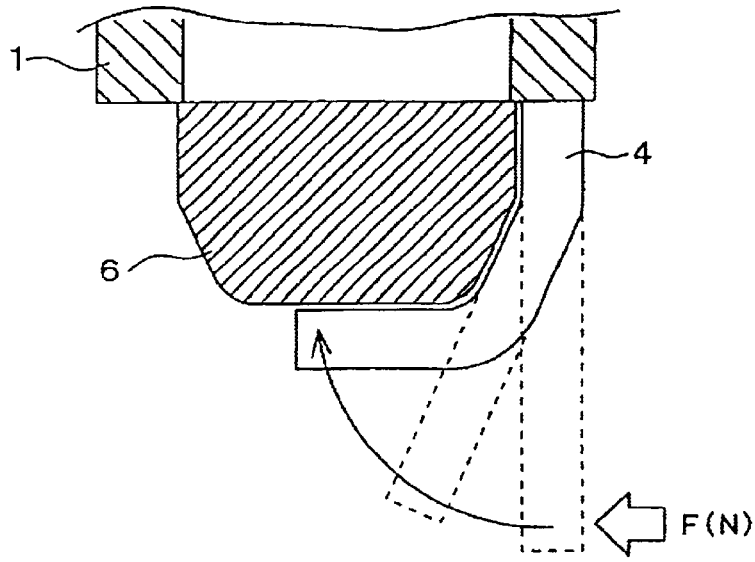
FIG. 6 is a partially sectional view of a spark plug sample used in evaluating the bendability of a ground electrode.

The evaluation of the bendability of the ground electrode 4 was made by measuring a load F, as shown in FIG. 6, required to bend the ground electrode 4 to a substantially L-shape using a bending guide 6. Spark plug sample used in this evaluation were each equipped with the ground electrode 4 made of one of the materials Nos. 5 and 7–10 whose Cr and Al contents are the greatest, that is, the material No.10 which is the hardest and most difficult to bend. Some of the spark plug samples each had the ground electrode 4 joined to the metal shell 1 by resistance welding in a substantially oxygen free atmosphere, i.e., an inert gas such as Ar gas. The remaining spark plug samples each had the ground electrode 4 jointed to the metal shell 1 by resistance welding in the air.

The high temperature oxidation resistance of the ground electrode 4 was evaluated by performing the same durability tests as described above in FIG. 2 and measuring the gap increase ΔG. The tests employed spark plug samples each equipped with the ground electrode 4 made of one of the materials Nos. 5 and 7–10 in FIG. 2 which is the greatest in gap increase ΔG within a range of less than or equal to 0.3 mm, that is, the material No.5.

Figure 7:
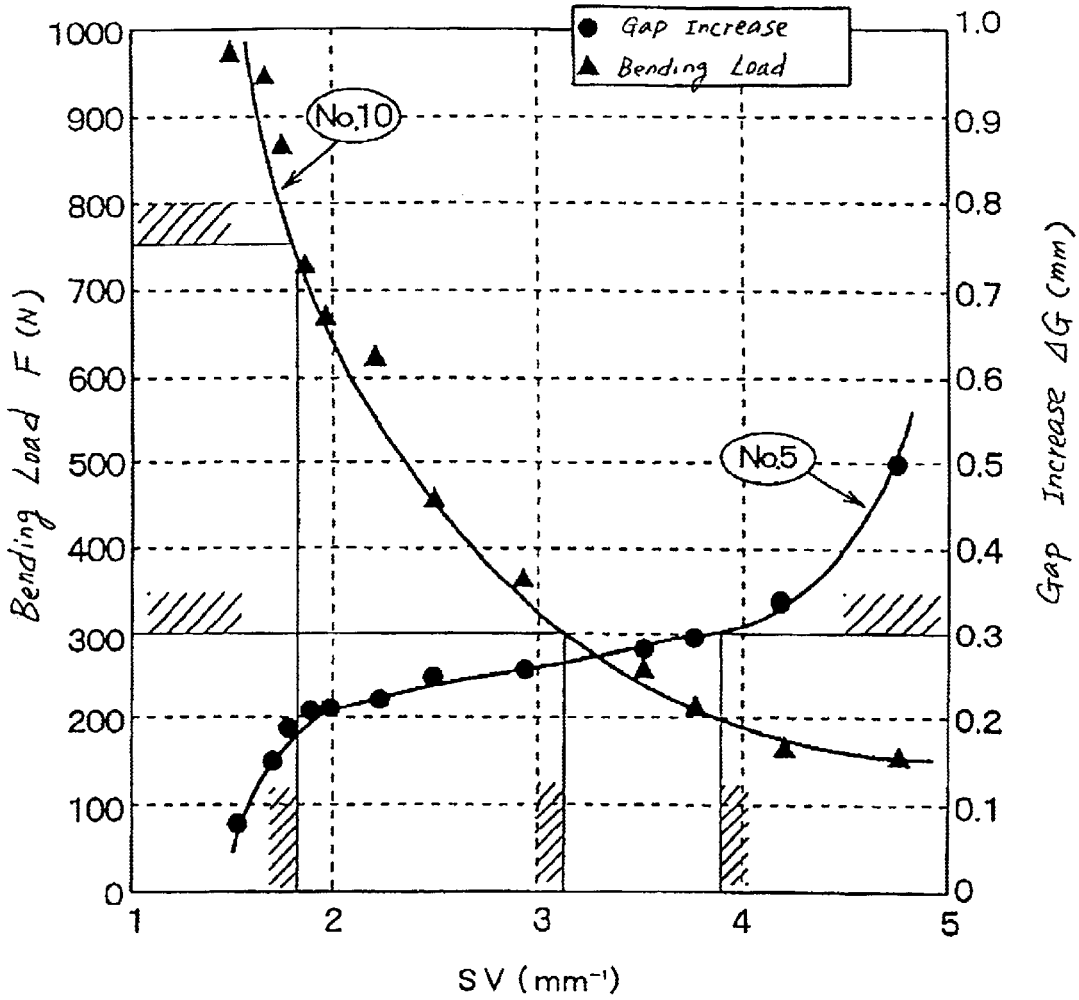
FIG. 7 is a graph which represents changes in bending load on a ground electrode and gap increase of the ground electrode for different values of a area-to-volume ratio S/V.

FIG. 7 represents changes in bendability and gap increase ΔG of the ground electrode 4 for different values of the area-to-volume ratio S/V. Black triangular marks indicate the loads Fused in bending the ground electrodes 4 made of the material No.10 of the above spark plug samples. Black circular marks indicate the gap increases ΔG of the ground electrodes 4 made of the material No.5 of the above spark plug samples.

As already described, when the gap increase ΔG is 0.3 mm or less, it provides a high temperature oxidation resistance required in practical use. The graph of FIG. 7, thus, shows that when the area-to-volume ratio S/V is less than or equal to 3.9 $mm^{-1}$, it provides the desired high temperature oxidation resistance.

Results of an analysis of the bendability tests showed that the spark plug samples in which the ground electrode 4 is joined to the metal shell 1 by resistance welding in the air (will also be referred to in-air welded spark plug samples below) are subject to rupture at a weld interface thereof when the load F to bend the ground electrode 4 exceeds 300N, while the spark plug samples in which the ground electrode 4 is welded to the metal shell 1 by resistance welding in the oxygen free atmosphere (will also be referred to as in-oxygen free atmosphere welded spark plug samples below) have no oxide film formed on a weld interface thereof, thus resulting in an increase in mechanical strength of the weld, and are not subject to rupture at the weld interface when the load F is less than or equal to 750N.

It will, therefore, be clear from the graph of FIG. 7 that the in-air welded spark plug samples are not subject to rupture at the weld interface thereof when the area-to-volume ratio S/V is more than or equal to 3.2 $mm^{-1}$, and the in-oxygen free atmosphere welded spark plug samples are not subject to rupture at the weld interface thereof when the area-to-volume ratio S/V is more than or equal to 1.8 $mm^{-1}$.

Results of the above analyses show that the in-air welded spark plug samples meet the desired high temperature oxidation resistance and are not subject to rupture at the weld interface thereof during bending of the ground electrode 4 when 3.2 $mm^{-1} \leqq S/V \leqq 3.9\ mm^{-1}$, and the in-oxygen free atmosphere welded spark plug samples meet the desired high temperature oxidation resistance and are not subject to rupture at the weld interface thereof during bending of the ground electrode 4 when 1.8 $mm^{-1} \leqq S/V \leqq 3.9\ mm^{-1}$.

It is, therefore, appreciated that the in-oxygen free atmosphere welded spark plug samples have an increased range of values of S/V, thus resulting in an increase in degree of design freedom.

We also studied the resistance welding performed while applying a jet of oxygen free gas to a welding target suitable for mass production of spark plugs.

Figure 8A:
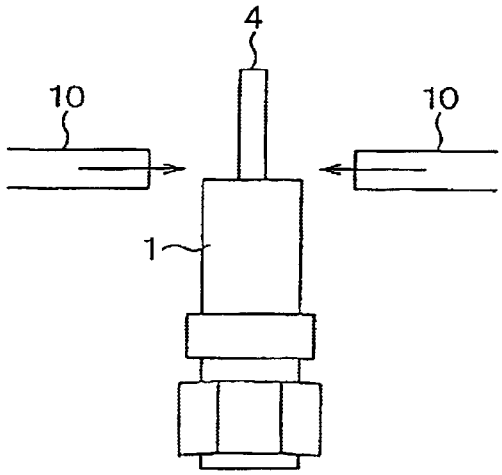
FIG. 8(*a*) is a side view which shows nozzles producing jets of oxygen free gas used in welding a ground electrode to a metal shell.
Figure 8B:
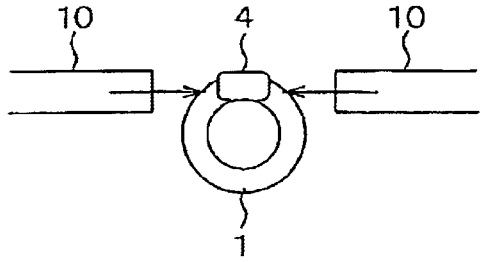

We performed welding tests, as shown in FIGS. 8(*a*) and 8(*b*), in which ends of the ground electrode 4 and the metal shell 1 of spark plug samples were joined by the resistance welding while applying jets of oxygen free gas thereto using nozzles 10 disposed on opposite sides of the ends of the ground electrode 4 and the metal shell 1. The inner diameter of the nozzles 10 was 5 mm. The distance between the tip of the nozzles 10 and the ends of the ground electrode 4 and the metal shell 1 to be welded was 30 mm. Ar was used as the oxygen free gas.

Figure 9:
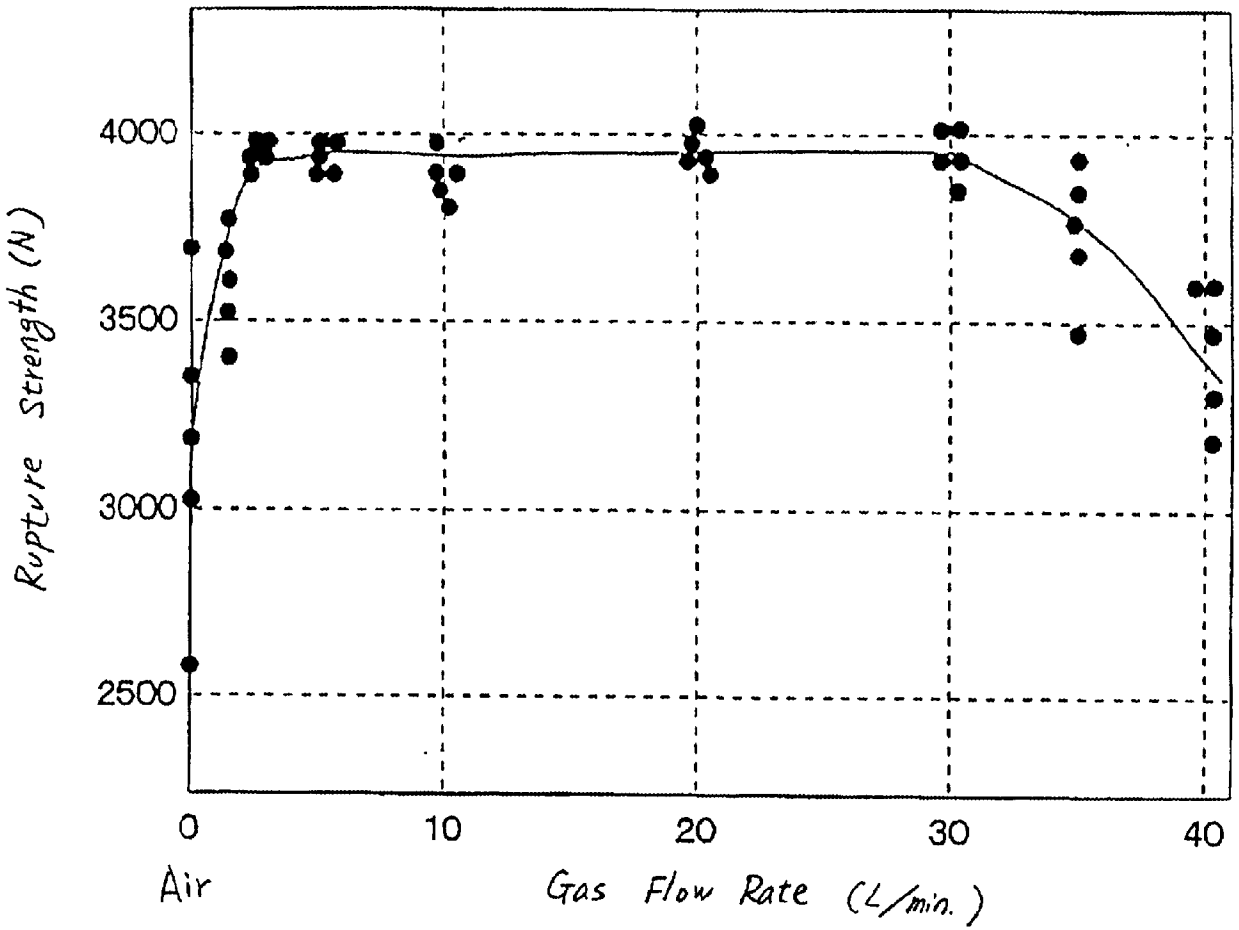
FIG. 9 is a graph which shows a relation between a flow rate of oxygen free gas used in welding a ground electrode to a metal shell and a rupture strength of a weld therebetween.

We analyzed, as shown in FIG. 9, the rupture strength of the weld between the ground electrode 4 and the metal shell 1 in terms of a flow rate of the oxygen free gas.

The graph of FIG. 9 shows that the rupture strength basically increases with an increase in flow rate of the oxygen free gas, but drops when the gas flow rate exceeds 30L(liter)/minute. This is because increasing the gas flow rate will result in an increase in concentration of the gas, so that the rupture strength is increased, while too much gas enhances the effect of cooling the weld, thereby resulting in a drop in rupture strength of the weld. It is, thus, appreciated that the flow rate of the oxygen feed gas used in the resistance welding is preferably within a range of 2L to 30L/min.

We also observed the weld interface of the spark plug samples welded in the manner, as illustrated in FIG. 8, and found that the welding in the air results in oxidation of Al that is a component of the ground electrode 4, so that aluminum oxide is deposited on the weld interface. The aluminum oxide is usually a factor in decreasing the weld strength. Specifically, the aluminum oxide is not joined to either of the ground electrode 4 and the metal shell 1 and induces micro cracks therein when subjected to tension at which mechanical stress is concentrated, thus leading to peeling or rupture at the weld interface.

Figure 10:
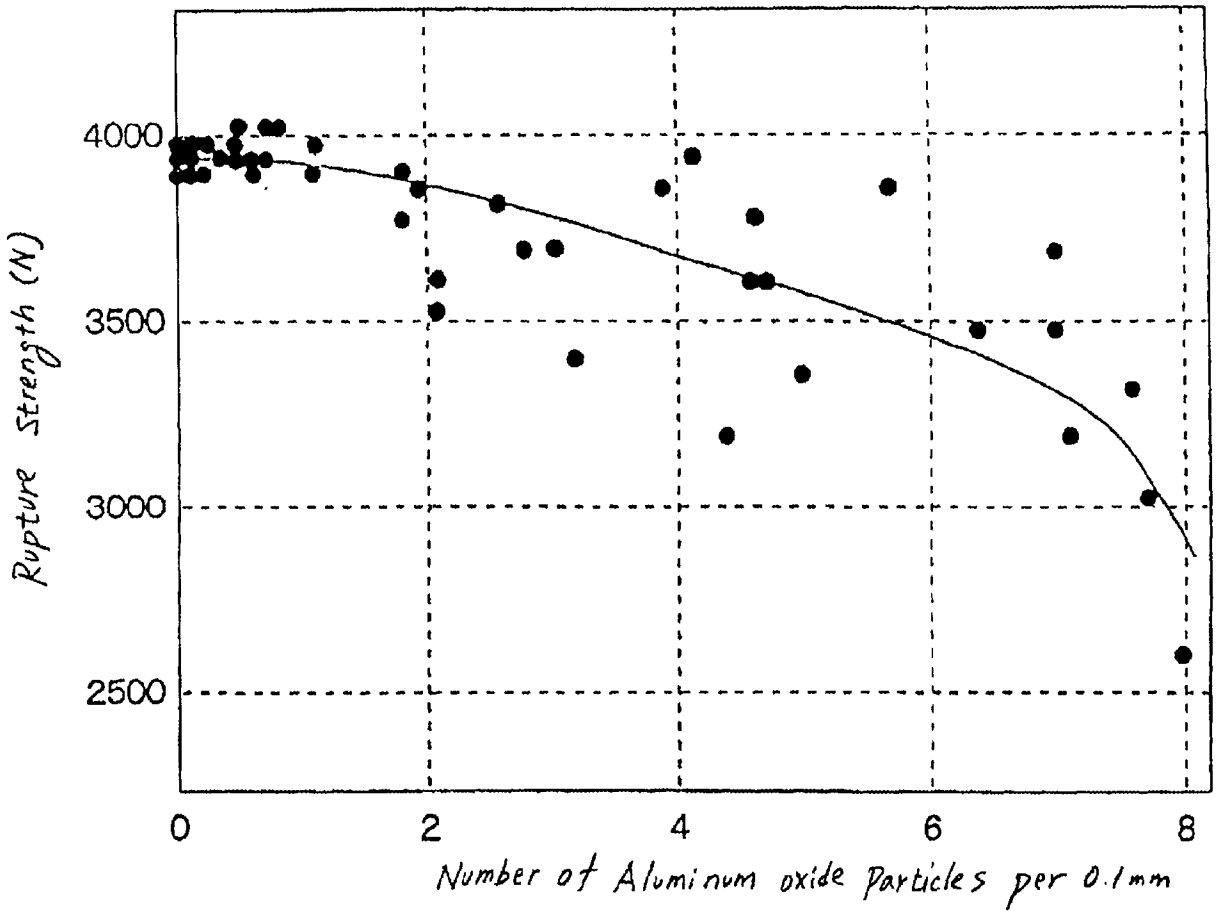
FIG. 10 is a graph which shows a relation between the number of aluminum oxide particles in a weld interface between a ground electrode and a metal shell and a rupture strength thereof.

FIG. 10 is a graph which represents a relation between rupture strength and the number of aluminum oxide particles per 0.1 mm in length of the weld interface. The graph shows that the rupture strength drops with an increase in number of the aluminum oxide particles, and a higher weld strength is provided when the number of aluminum oxide particles per 0.1 mm in length of the weld interface is one or less.

The ends of the ground electrode 4 and the metal shell 1 may be welded to each other within an closed chamber filled with an oxygen free gas or by applying a jet of oxygen free gas to a required portion of the ends at a required time using a nozzle.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A production method of a spark plug including a metal shell, a center electrode retained within the metal shell through electric insulation, and a ground electrode opposed to the center electrode through a spark gap, comprising the steps of:

preparing the ground electrode made of a Ni-based alloy containing 10% or more by weight of Cr and 1.5% or more by weight of Al; and joining the ground electrode to the metal shell by resistance welding in a substantially oxygen free atmosphere.

2. A production method as set forth in claim 1, wherein the ground electrode contains 20% or less by weight of Cr and 5% or less of weight of Al.

3. A production method as set forth in claim 1, wherein the oxygen free atmosphere is provided by an inert gas.

4. A production method as set forth in claim 3, wherein the inert gas is Ar.

5. A production method as set forth in claim 1, wherein if a ratio of a surface area S of the ground electrode to a volume V of the ground electrode is defined as S/V, a relation of $1.8\ mm^{-1} \leqq S/V \leqq 3.9\ mm^{-1}$ is met.

6. A production method as set forth in claim 1, wherein the resistance welding is performed while applying a jet of given gas producing the oxygen free atmosphere to portions of the ground electrode and the metal shell to be joined.

7. A production method as set forth in claim 6, wherein a flow rate of the jet of the given gas is within a range of 2L to 30L per minute.

8. A spark plug comprising:

a metal shell;

a center electrode retained within said metal shell through electric insulation; and a ground electrode joined at an end thereof to said metal shell by resistance welding and opposed at the other end to said center electrode through a spark gap, said ground electrode containing 10% or more by weight of Cr and 1.5% or more by weight of Al, the number of aluminum oxide particles per 0.1 mm in length of a weld interface between the end of said ground electrode and said metal shell being one or less.

9. A spark plug as set forth in claim 8, wherein said ground electrode is made of a Ni-based alloy containing 20% or less by weight of Cr and 5% of less by weight of Al.

* * * * *